US008727751B2

(12) United States Patent
Schofield

(10) Patent No.: US 8,727,751 B2
(45) Date of Patent: May 20, 2014

(54) VACUUM PUMPING ARRANGEMENT

(75) Inventor: Nigel Paul Schofield, Horsham (GB)

(73) Assignee: Edwards Limited, West Sussex (GB)

( * ) Notice: Subject to any disclaimer, the term of this patent is extended or adjusted under 35 U.S.C. 154(b) by 1676 days.

(21) Appl. No.: 10/536,781

(22) PCT Filed: Dec. 9, 2003

(86) PCT No.: PCT/GB03/05370

§ 371 (c)(1),
(2), (4) Date: Oct. 11, 2005

(87) PCT Pub. No.: WO2004/055375

PCT Pub. Date: Jul. 1, 2004

(65) Prior Publication Data

US 2006/0140795 A1 Jun. 29, 2006

(30) Foreign Application Priority Data

Dec. 17, 2002 (GB) ..... 0229355.3

(51) Int. Cl.
*F04D 19/04* (2006.01)

(52) U.S. Cl.
USPC ..... 417/423.4; 417/203; 417/423.5; 415/143

(58) Field of Classification Search
USPC ..... 417/423.5, 423.4, 203; 415/90, 143
See application file for complete search history.

(56) References Cited

U.S. PATENT DOCUMENTS

| | | | | |
|---|---|---|---|---|
| 4,465,434 | A * | 8/1984 | Rourk | 416/230 |
| 5,230,924 | A | 7/1993 | Li | |
| 5,374,160 | A * | 12/1994 | Hablanian | 415/90 |
| 5,611,660 | A | 3/1997 | Wong et al. | |
| 5,848,873 | A * | 12/1998 | Schofield | 415/90 |
| 5,893,702 | A | 4/1999 | Conrad et al. | |
| 6,135,709 | A * | 10/2000 | Stones | 415/90 |
| 6,168,374 | B1 | 1/2001 | Stolle et al. | |
| 6,220,824 | B1 | 4/2001 | Hablanian | |
| 6,422,829 | B1 | 7/2002 | Schutz | |
| 2002/0054815 | A1 | 5/2002 | Kawasaki et al. | |

FOREIGN PATENT DOCUMENTS

| | | | |
|---|---|---|---|
| EP | 0 959 253 | A2 | 11/1999 |
| EP | 1 101 945 | A2 | 5/2001 |
| JP | H0259294 | A | 4/1990 |
| JP | H0444496 | | 4/1992 |
| JP | H0538389 | | 5/1993 |
| JP | H05332286 | A | 12/1993 |
| JP | H0904594 | A | 1/1997 |
| JP | H1077990 | A | 3/1998 |
| JP | H11351190 | A | 12/1999 |

(Continued)

OTHER PUBLICATIONS

United Kingdom Search Report of Application No. GB 0229355.3; Date of search: Jul. 16, 2003.

(Continued)

*Primary Examiner* — Charles Freay
*Assistant Examiner* — Philip Stimpert
(74) *Attorney, Agent, or Firm* — Westman, Champlin & Koehler, P.A.

(57) ABSTRACT

A vacuum pumping arrangement comprises a turbomolecular pumping mechanism and a molecular drag pumping mechanism connected in series. A rotor of the molecular drag pumping mechanism is supported by the rotor blades of the turbomolecular pumping mechanism.

12 Claims, 5 Drawing Sheets

(56) References Cited

FOREIGN PATENT DOCUMENTS

| | | | |
|---|---|---|---|
| JP | 2000516321 | A | 12/2000 |
| JP | 2001517757 | | 10/2001 |
| JP | 2001323892 | A | 11/2001 |
| JP | 2002180989 | A | 6/2002 |
| JP | 2003172289 | A | 6/2003 |
| WO | 0111240 | A1 | 2/2001 |

OTHER PUBLICATIONS

PCT International Search Report of International Application No. PCT/GB03/05370; Date of mailing of the International Search Report: Apr. 29, 2004.

Prosecution documents for corresponding European Patent Application No. 03786099.6 including: Communication dated Oct. 24, 2005 and Communication dated Jul. 14, 2006.

Prosecution documents for corresponding Japanese Patent Application No. 2004/559871 including: Notification of Reasons for Refusal dated Mar. 16, 2009; Response dated Sep. 15, 2009; Notification of Reason for Rejection dated Apr. 19, 2010; Response dated Apr. 27, 2010; Notification of Reason for Rejection Aug. 2010.

Prosecution documents for corresponding Taiwanese Patent Application No. 092135767 including: Response dated Jun. 5, 2009; Office Action dated May 18, 2009; Search Report dated May 15, 2009; Office Action dated Oct. 12, 2010.

* cited by examiner

VACUUM PUMPING ARRANGEMENT

FIELD OF THE INVENTION

The present invention relates to a vacuum pumping arrangement comprising a turbomolecular pumping mechanism and a molecular drag pumping mechanism connected in series.

BACKGROUND OF THE INVENTION

A known vacuum pumping arrangement comprises a turbomolecular pumping mechanism connected in series with a molecular drag pumping mechanism, the latter of which can be of any suitable type such as a Holweck or a Gaede type pumping mechanism. A backing pump is generally provided to reduce pressure at the exhaust of the arrangement and may be of any suitable type such as a regenerative pump or claw pump.

The turbomolecular pumping mechanism comprises one or more circumferential arrays of angled blades supported at a generally cylindrical rotor body. During normal operation, the rotor, which is coupled to a drive, shaft, is rotated between 20,000 and 200,000 revolutions per minute, during which time the rotor blades collide with molecules in a gas urging them towards the pump outlet. The molecular drag pumping mechanism comprises a rotor, which may comprise a hollow cylinder in a Holweck type pumping mechanism, coupled to the drive shaft for simultaneous rotation with the turbomolecular pumping mechanism. Rotation of the molecular drag pumping mechanism imparts a velocity to gas molecules entering it from the exhaust of the turbomolecular pumping mechanism tangentially to the circumference of the cylinder and along spiral channels formed between a stator and the cylinder towards the drag outlet.

The cylinder of a Holweck type pumping mechanism extends generally axially with a circumference about the axis of the drive shaft, and is supported by an apertured plate extending radially from the drive shaft between the turbomolecular pumping mechanism and the cylinder. Therefore, in use, gas passes from the outlet of the turbomolecular pumping mechanism, through the apertured plate and into the molecular drag pumping mechanism.

It is desirable to provide an improved vacuum pumping arrangement.

BRIEF SUMMARY OF THE INVENTION

The present invention provides a pumping arrangement comprising a turbomolecular pumping mechanism and a molecular drag pumping mechanism connected in series, a rotor of the molecular drag pumping mechanism being supported by the rotor blades of the turbomolecular pumping mechanism.

Other aspects of the present invention are defined in the accompanying claims.

BRIEF DESCRIPTION OF THE DRAWINGS

In order that the present invention may be well understood, two embodiments thereof, which are given by way of example only, will now be described with reference to the accompanying drawings, in which.

DETAILED DESCRIPTION OF THE INVENTION

Figure 1:
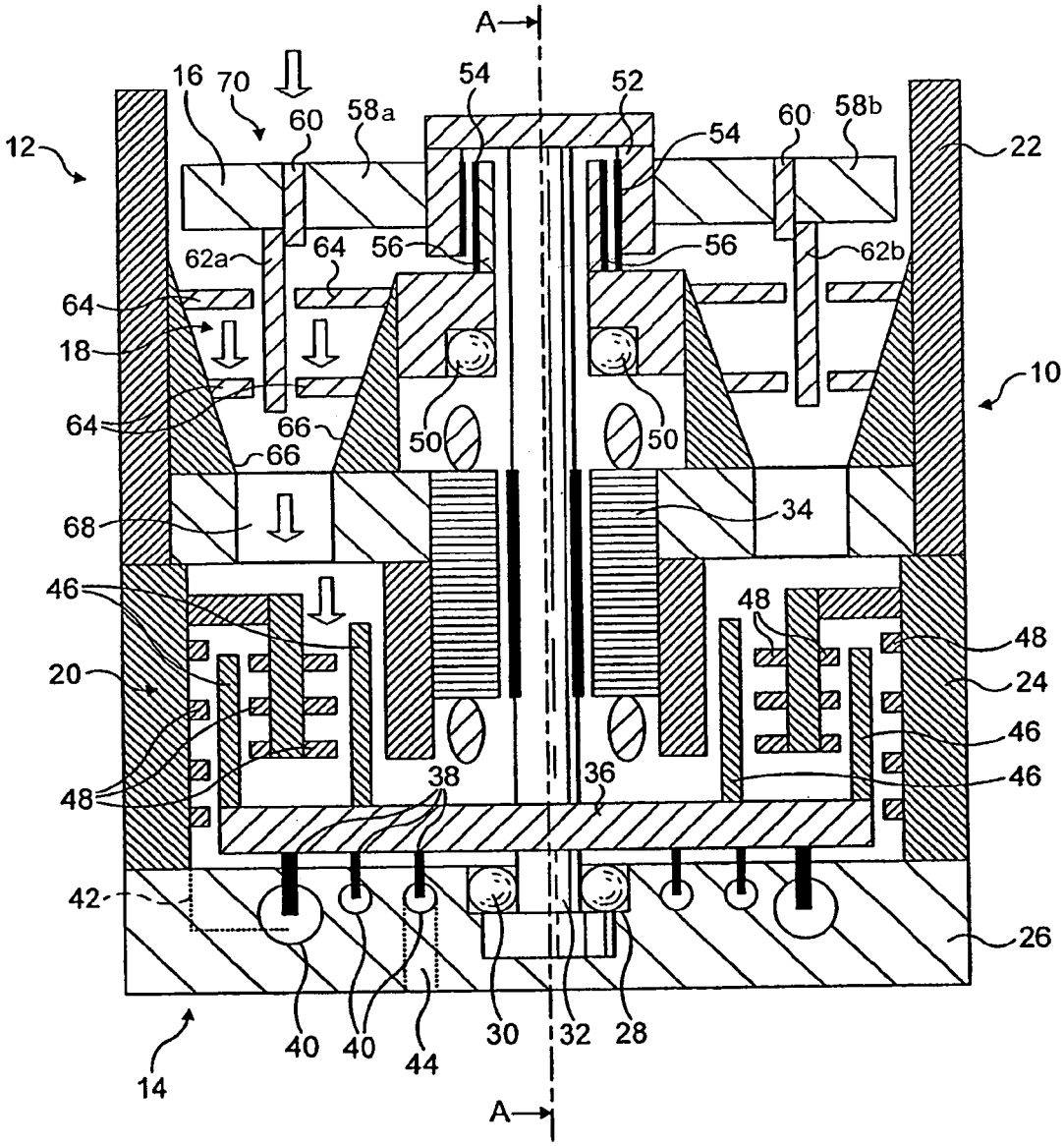
FIG. 1 is a cross-sectional view of a vacuum pumping arrangement shown schematically.
Figure 2:
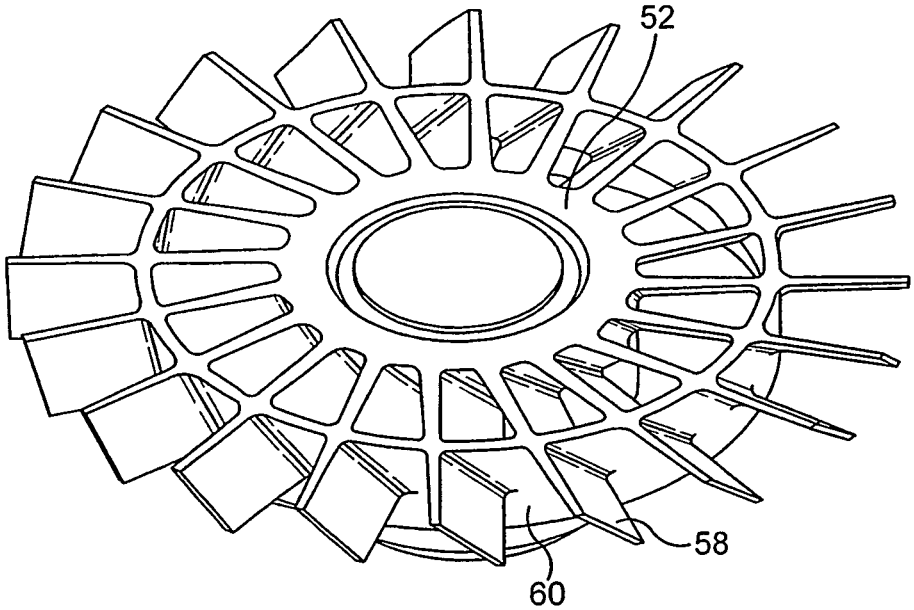
FIG. 2 is a perspective view from above and one side of a rotor of a turbomolecular pumping mechanism.
Figure 3:
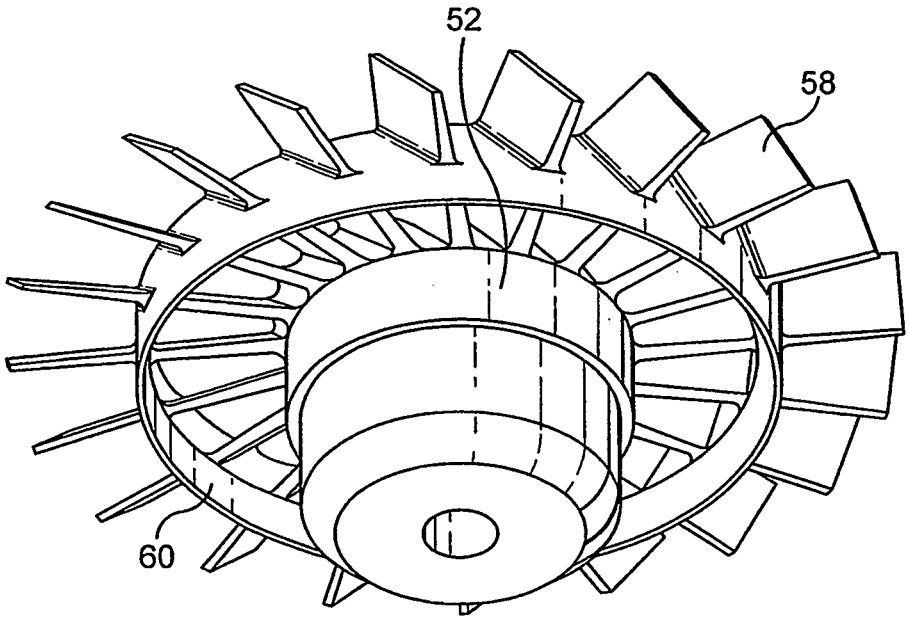
FIG. 3 is a perspective view from below and one side of the rotor in FIG. 2.
Figure 4:
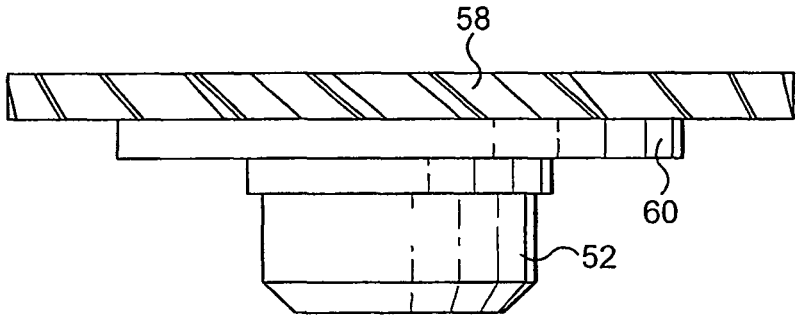
FIG. 4 is an elevation of the rotor in FIG. 2.
Figure 5:
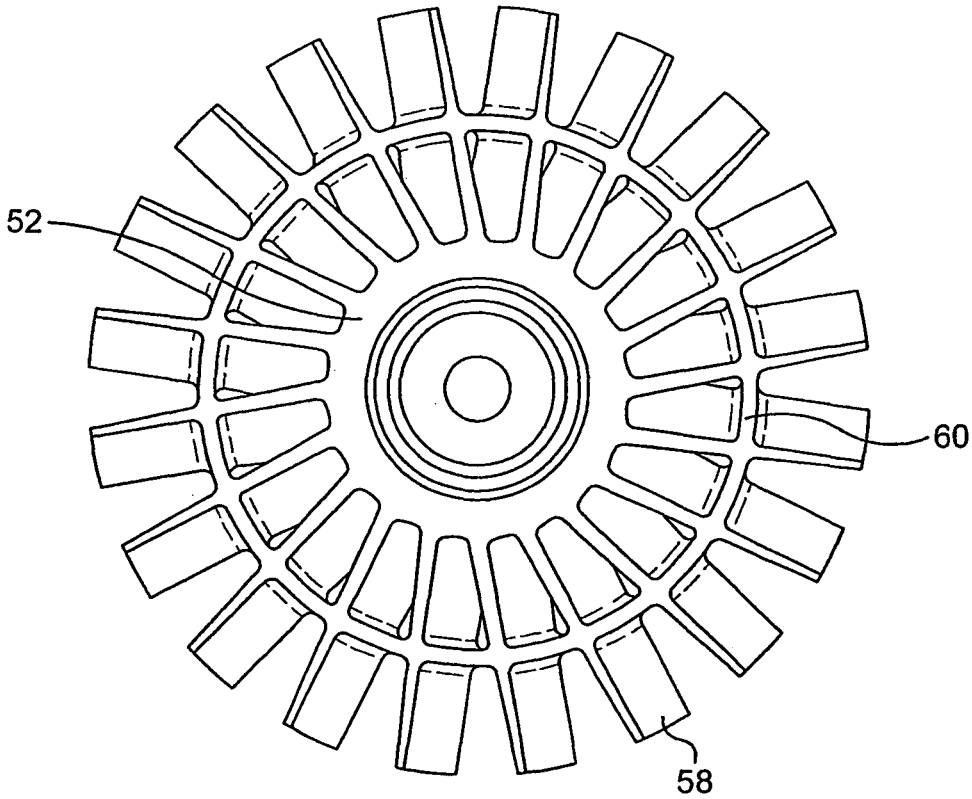
FIG. 5 is a plan of the rotor in FIG. 2.

Referring to FIG. 1, vacuum pumping arrangement 10 is shown, which comprises a molecular pumping mechanism 12 and a backing pumping mechanism 14. The molecular pumping mechanism 12 comprises a turbomolecular pumping mechanism 16 and a molecular drag, or friction, pumping mechanism 18 connected in series. The backing pumping mechanism 14 comprises a regenerative pumping mechanism, which as shown is provided and driven on the same drive shaft as the molecular pumping mechanism. Alternatively, a backing pump may be provided as a separate unit from the molecular pumping mechanism. A further molecular drag pumping mechanism 20 may be provided between molecular drag pumping mechanism 18 and regenerative pumping mechanism 14. Molecular drag pumping mechanism 20 comprises three drag pumping stages in series, whereas molecular drag pumping mechanism 18 comprises two drag pumping stages in parallel.

Vacuum pumping arrangement 10 comprises a housing in three separate parts 22, 24, 26. Parts 22 and 24 may form the inner surfaces of the molecular pumping mechanism 12 and the molecular drag pumping mechanism 20, as shown. Part 26 may form the stator of the regenerative pumping mechanism 14.

Part 26 defines a counter-sunk recess 28 which receives a lubricated bearing 30 for supporting a drive shaft 32. Bearing 30 may be lubricated, for instance with grease, because it is in a part of the pumping arrangement 10 distal from the inlet of the pumping arrangement. The inlet of the pumping arrangement maybe in fluid connection with a semiconductor processing chamber in which a clean or oil free environment is required.

Drive shaft 32 is driven by motor 34 which as shown is supported by parts 22 and 24 of the housing. The motor may be supported at any convenient position in the vacuum pumping arrangement. Motor 34 is adapted to be able to power the regenerative pumping mechanism 14, molecular drag pumping mechanism 20 and molecular pumping mechanism 12. Generally, a regenerative pumping mechanism requires more power for operation than a molecular pumping mechanism, the regenerative pumping mechanism operating at pressures close to atmosphere where windage and air resistance is relatively high. A turbomolecular pumping mechanism, or molecular drag pumping mechanism requires relatively less power for operation, and therefore, a motor selected for powering a regenerative pump is also generally suitable for powering a turbomolecular pumping mechanism or molecular drag-pumping mechanism.

Regenerative pumping mechanism 14 comprises a rotor fixed relative to drive shaft 32. As shown, the regenerative pumping mechanism 14 comprises three pumping stages, and for each stage, a circumferential array of rotor blades 38 extends substantially orthogonally from one surface of the rotor body 36. The rotor blades 38 of the three arrays extend axially into respective circumferential pumping channels 40 disposed concentrically in part 26 which constitutes the stator of the regenerative pumping mechanism 14. During operation, drive shaft 32 rotates rotor body 36 which causes the rotor blades 38 to travel along the pumping channels, pumping gas from inlet 42 in sequence along the radially outer pumping channel, radially middle pumping channel and radially inner pumping channel where it is exhausted from exhaust 44 at pressures close to or at atmospheric pressure.

Extending orthogonally from the rotor body 36 are two cylindrical drag cylinders 46 which together form the rotors of molecular drag pumping mechanism 20. The drag cylinders 46 are made from carbon fibre composite material which is both strong and light. The reduction in mass when using carbon fibre composite material drag cylinders produces less inertia when the molecular drag pumping mechanism is in operation. Accordingly, the speed of the molecular drag pumping mechanism is easier to control.

The molecular drag pumping mechanism 20 shown schematically is a Holweck type drag pump in which stator portions 48 define a spiral channel between the inner surface of housing part 24 and the drag cylinders 46. Three drag stages are shown, each of which provides a spiral path for gas flow between the rotor and the stator. The gas flow follows a tortuous path flowing consecutively through the drag stages in series.

The molecular pumping mechanism 12 is driven at an end of drive shaft 32 distal from the regenerative pumping mechanism 14. The drive shaft 32 may optionally be supported by back up bearing. A magnetic bearing 54 is provided between rotor body 52 and a cylindrical portion 56 fixed relative to the housing 22. A passive magnetic bearing is shown in which like poles of a magnet repel each other resisting radial movement of rotor body 52 relative to the central axis A. Other types of suitable bearings may be used as required.

A circumferential array of angled rotor blades 58*a*, 58*b* (collectively 58) extend radially outwardly from rotor body 52. At approximately half way along the radial length of the rotor blades, an annular support ring 60 is provided, to which is fixed the drag cylinder, or rotor, 62*a* 62*b* (collectively 62) of molecular drag pumping mechanism 18, so that the rotor blades of the turbomolecular pumping mechanism support the rotor of the molecular drag pumping mechanism. Molecular drag pumping mechanism 18 comprises two drag stages in parallel with a single drag cylinder 62, one stage being radially inward thereof and one stage being radially outward thereof. Each of the stages comprise stator portions 64 with tapered inner walls 66 of the housing 22 forming a spiral molecular gas flow channel. An outlet 68 is provided to exhaust gas from the molecular drag pumping mechanism 18.

The use of the rotor blades of the turbomolecular pumping mechanism 16 for supporting the rotor of the molecular drag pumping mechanism 18 avoids the need to provide a separate support plate for the rotor of the molecular drag pumping mechanism as used in the prior art described above. Therefore, the molecular pumping mechanism is less complicated and more compact than in the prior art. Also, it will be appreciated that the support plate, albeit an apertured support plate, will to some extent reduce the flow of gas between the turbomolecular pumping mechanism and the molecular drag pumping mechanism and therefore, act as an impediment to efficiency. There is no such impediment with the arrangement of FIG. 1 where gas is allowed to flow freely from the turbomolecular pumping mechanism to the molecular drag pumping mechanism.

FIGS. 2 to 5 show the rotor of the turbomolecular pumping mechanism 16 in more detail. The rotor comprises the rotor body 52 which forms a hub for coupling to the drive shaft 32 (not shown in these Figures). Extending radially outwardly from the rotor body 52 are the plurality of angled rotor blades 58. Integrally formed with the rotor blades 58 is the annular ring 60 which is provided at a central radial portion of the rotor blades, or about half way along their length. The rotor, or cylinder, of the molecular drag pumping mechanism is fixed to the annular ring by any suitable method so that the rotor blades can support the rotor of the molecular drag pumping mechanism.

During normal operation, inlet 70 of pump arrangement 10 is connected to a chamber, the pressure of which it is desired to be reduced. Motor 34 rotates drive shaft 32 which in turn drives rotor body 36 and rotor body 52. Gas in molecular flow conditions is drawn in through inlet 70 to the turbomolecular pumping mechanism 16 where it is urged by the rotor blades 58 along both parallel drag pumping stages 18 and through outlet 68. Gas is then drawn through the three stages in series of the molecular drag pumping mechanism 20 and into the regenerative pumping mechanism through inlet 42. Gas is exhausted at atmospheric pressure or thereabouts through exhaust port 44.

There now follows a description of a further embodiment of the present invention. For brevity, the further embodiment will be discussed only in relation to the parts thereof which are different to the first embodiment and like reference numerals will be used for like parts.

Figure 6:
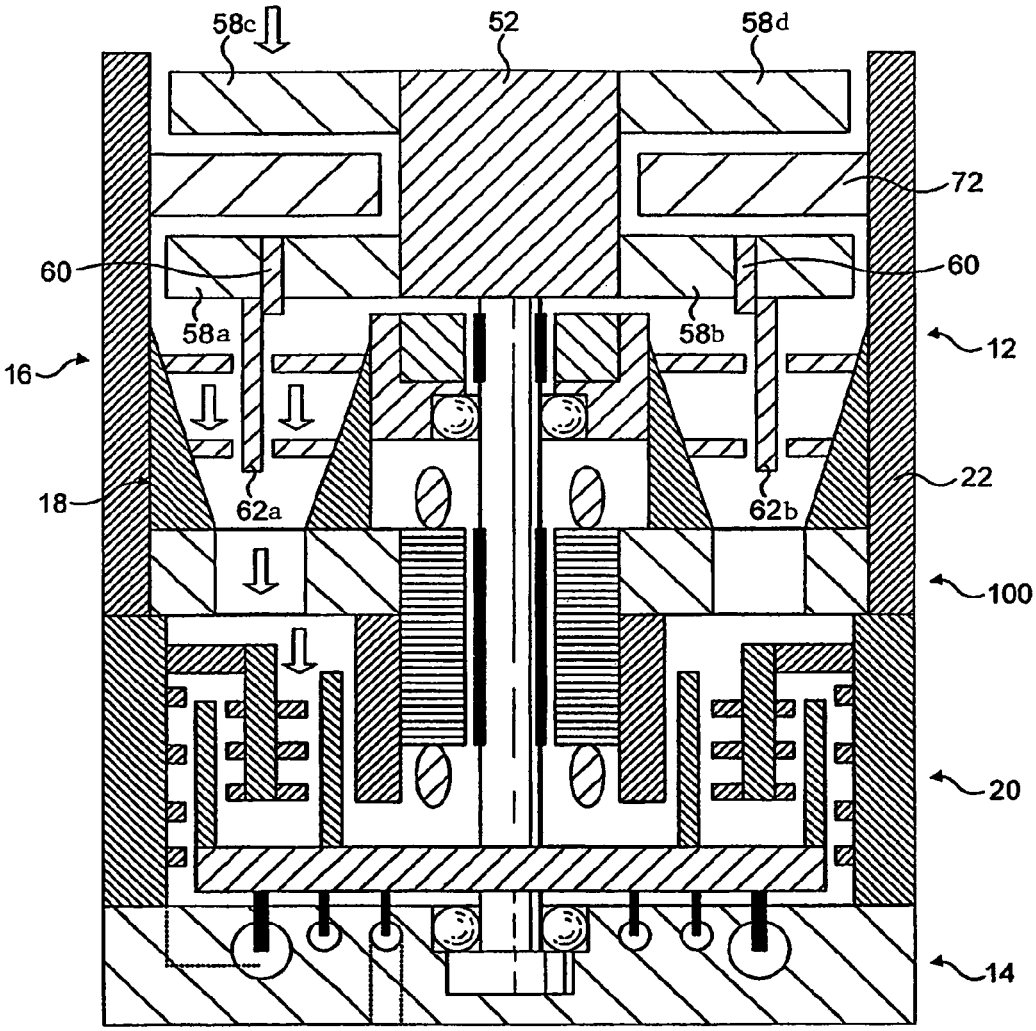
FIG. 6 is a cross-sectional view of another vacuum pumping arrangement shown schematically.

FIG. 6 shows a vacuum pumping arrangement 100 in which the molecular pumping mechanism 12 comprises a turbomolecular pumping mechanism 16 having two pumping stages in series.

Two arrays of angled rotor blades 58*a*, 58*b*, 58*c*, 58*d* (collectively 58) extend radially outwardly from the hub of the rotor body 52 with a stator formation 72 between the arrays. The rotor blades of the downstream or last stage of the turbomolecular pumping, mechanism support the rotor of the molecular drag pumping mechanism and are provided with the annular ring 60 to which the rotor of the molecular drag pumping mechanism is fixed.

Figure 7:
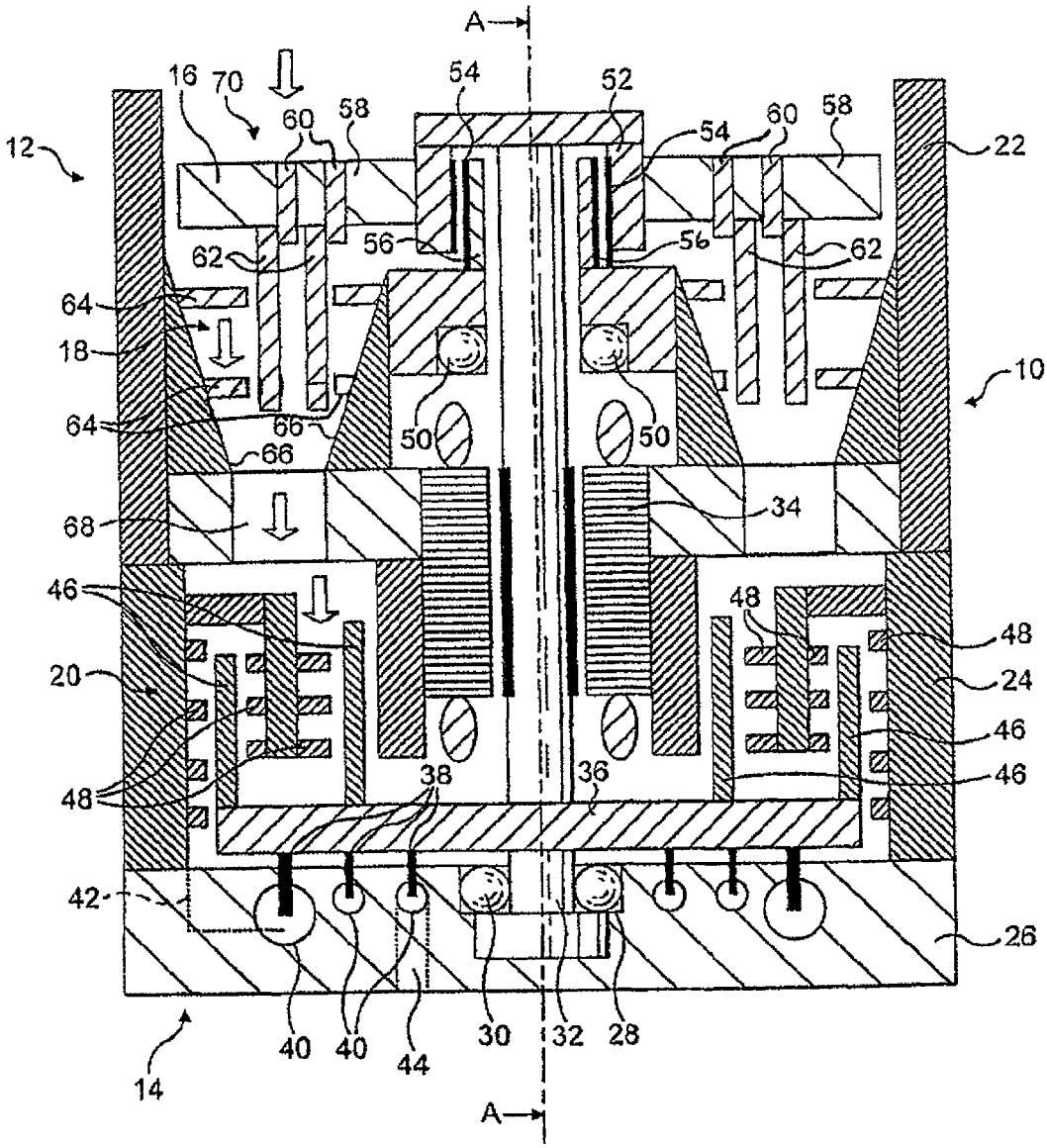
FIG. 7 is a cross-sectional view of another vacuum pumping arrangement shown schematically.

In a modification of the embodiments described above (See FIG. 7), the molecular drag pumping mechanism 18 comprises more than one drag cylinder, or rotor, 62 supported by the rotor blades 58 of the turbomolecular pumping mechanism 16. As shown in FIG. 7, the turbo blades may therefore be provided with radially spaced annular rings to which are fixed respective drag pump rotors. With this arrangement, for example, if there are three drag pump rotors, there can be up to six parallel drag pump stages, with two parallel pumping paths radially inwardly and radially outwardly of each rotor.

Although the present invention has been described with reference to FIGS. 1 and 6 in which molecular pumping mechanism 12 is driven by a common shaft with regenerative pumping mechanism 14 and which together form one pumping unit, the present invention is not restricted in this way. Alternatively, the molecular pumping mechanism may form a pumping unit separate from the regenerative pumping mechanism, both of which are driven by separate motors and separate drive shafts.

I claim:

1. A vacuum pumping arrangement comprising:

a turbomolecular pumping mechanism having a rotor, wherein the rotor comprises a rotor body and rotor blades extending radially outwards from the rotor body; and a molecular drag pumping mechanism connected in series with the turbomolecular pumping mechanism, wherein a rotor of the molecular drag pumping mechanism is affixed to the rotor blades of the turbomolecular pumping mechanism; and wherein the rotor blades of the turbomolecular pumping mechanism are provided with an annular ring, disposed co-axially with the rotor body and positioned between two ends of each of the rotor blades in a radial direction, to which the rotor of the molecular drag pumping mechanism is fixed.

2. The vacuum pumping arrangement as claimed in claim 1, wherein the turbomolecular pumping mechanism has a plurality of stages and the rotor blades of at least the last stage are provided with the annular ring.

3. The vacuum pumping arrangement as claimed in claim 1, wherein the rotor of the molecular drag pumping mechanism is supported approximately half way along the radial length of the rotor blades of the turbomolecular pumping mechanism.

4. The vacuum pumping arrangement as claimed in claim 1, wherein the molecular drag pumping mechanism has a plurality of rotors affixed to the rotor blades of the turbomolecular pumping mechanism.

5. The vacuum pumping arrangement as claimed in claim 1, wherein the rotor of the molecular drag pumping mechanism has associated therewith two parallel pumping paths comprising a pumping path radially inward of the rotor and a pumping path radially outward of the rotor.

6. The vacuum pumping arrangement as claimed in claim 1, wherein the molecular drag pumping mechanism is of a holweck type.

7. The vacuum pumping arrangement as claimed in claim 1, further comprising a second molecular drag pumping mechanism having a rotor, wherein the rotor of the second molecular drag pumping mechanism is supported by a rotor of a regenerative pumping exhausting mechanism.

8. The vacuum pumping arrangement as claimed in claim 1, wherein the rotor of the molecular drag pumping mechanism is made from a carbon fiber composite material.

9. The vacuum pumping arrangement as claimed in claim 1, wherein the rotor blades of the turbomolecular pumping mechanism are made from aluminum.

10. The vacuum pumping arrangement as claimed in claim 5, wherein the molecular drag pumping mechanism is of a holweck type.

11. The vacuum pumping arrangement as claimed in claim 4, further comprising a second molecular drag pumping mechanism having a rotor, wherein the rotor of the second molecular drag pumping mechanism is supported by the rotor of a regenerative pumping exhausting mechanism.

12. The vacuum pumping arrangement as claimed in claim 6, further comprising a second molecular drag pumping mechanism having a rotor, wherein the rotor of the second drag pumping mechanism is supported by the rotor of a regenerative pumping exhausting mechanism.

* * * * *

UNITED STATES PATENT AND TRADEMARK OFFICE

CERTIFICATE OF CORRECTION

PATENT NO. : 8,727,751 B2
APPLICATION NO. : 10/536781
DATED : May 20, 2014
INVENTOR(S) : Nigel Paul Schofield It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1809 days.

Signed and Sealed this
Twenty-ninth Day of September, 2015

Michelle K. Lee

Michelle K. Lee
*Director of the United States Patent and Trademark Office*